United States Patent [19]

Peterson

[11] 4,187,566

[45] Feb. 12, 1980

[54] WATER MATTRESS CONSTRUCTION

[75] Inventor: Warren E. Peterson, Santa Ana, Calif.

[73] Assignee: Wilshire Bedding Co., Inc., Los Angeles, Calif.

[21] Appl. No.: 876,073

[22] Filed: Feb. 8, 1978

[51] Int. Cl.[2] ..... A47C 27/08

[52] U.S. Cl. ..... 5/451; 5/474

[58] Field of Search ..... 5/367, 370, 371, 335, 5/355; 297/DIG. 1, DIG. 2, 445

[56] References Cited

U.S. PATENT DOCUMENTS

| | | | |
|---|---|---|---|
| 3,642,323 | 2/1972 | Taylor | 297/445 |
| 3,669,499 | 6/1972 | Semplonius | 297/445 |
| 3,742,531 | 7/1973 | Alsbury et al. | 5/370 |
| 3,761,130 | 9/1973 | Suzuki et al. | 297/445 |
| 3,815,165 | 6/1974 | Tobinick et al. | 5/370 |
| 4,015,299 | 4/1977 | Tinnel | 5/370 |
| 4,057,862 | 11/1977 | LaBianco | 5/370 |
| 4,062,077 | 12/1977 | Autrey et al. | 5/370 |

*Primary Examiner*—Casmir A. Nunberg
*Attorney, Agent, or Firm*—Jessup & Beecher

[57] ABSTRACT

A water mattress construction for a water bed having a foam assembly forming a cavity for surrounding and supporting a water-filled bladder. The foam assembly is formed of several layers of foam having different densities to provide strong support for the water bladder and prevent bulging. There are layers of low-density foam on the top and bottom of the foam assembly and a center core or frame of a medium density enclosing the cavity and bladder installed therein. The entire foam structure and bladder retain their shape by being bound on the sides and bottom by a high-strength, non-stretchable, non-woven fabric bonded securely to the foam assembly. The foam and bladder assembly is then covered with a low-density foam having a high recovery factor. The entire structure is then covered with a heavy-duty material and ticking which is quilted and has the appearance of a conventional mattress.

26 Claims, 3 Drawing Figures

WATER MATTRESS CONSTRUCTION

BACKGROUND OF THE INVENTION

This invention relates generally to water beds and more particularly relates to a water mattress of self-supporting construction.

Flotation sleeping systems and in particular water beds have been around for a long period of time and have been used extensively for therapeutic purposes for treatment of bedridden patients, such as burn patients. More recently they have achieved acceptance by the general public for sleeping systems. However, they have not received the wide acceptance of the general public because of a number of serious drawbacks to these types of sleeping sysems. Among these is the necessity of heating the water to provide adequate sleeping comfort. In addition, they are bulky, cumbersome, and generally extremely heavy. Also, they require a very rigid frame in order to contain the bladder or enclosure in which the water is contained. Some attempts have been made to construct a flexible frame for supporting the water container or bladder, but with time these devices have become distorted from the weight of the water. That is, the sides, ends or bottom have begun to bulge after a period of use.

SUMMARY OF THE INVENTION

The purpose of the present invention is to provide a self-supporting, flexible frame for a water bed mattress having the appearance of a conventional mattress.

A water bed mattress construction is disclosed having a foam frame assembly which is entirely self supporting and will retain its shape over a long period of time. A foam frame assembly is constructed of layers of foam having different densities bonded together to form a cavity for supporting a water container or bladder. The cavity formed by the foam frame is shaped substantially like an inverted truncated pyramid having sides at approximately 50° to the horizontal for providing uniform support for the user. The top layer of foam around the perimeter of the cavity is constructed of a foam having a high recovery factor so that continuous use will not result in apparent indentations or displacement of material (i.e., a compression set). The entire foam assembly and bladder is enclosed in a cover made from a heavy-duty decorative material with the top quilted with a half-inch of foam and this is further ticked with a one-inch layer of similar foam. This construction is then totally encapsulated when a high-strength, low-stretch olefin, non-woven fabric is sewn to the base of the cover. The 1½ inch cover provides a high-insulation factor, negating the need for a water heater.

The foam frame assembly has the bottom and sides securely bound with a non-stretchable fabric which prevents the water bladder from bowing or bending the frame. In addition, the non-stretchable fabric binder is bonded securely to the foam with an adhesive to prevent any shifting of the frame within the binder. The binder is formed of a non-woven, non-stretchable olefin fabric formed into a rectangular box construction fitted over the foam frame assembly and securely bonded to the foam. The cavity for the water bladder and sides and top of the foam frame assembly are covered with a contoured vinyl liner to protect the foam frame from any leakage or spillage when the bladder is being filled, or if accidentally punctured or burned.

The cover enclosing the entire assembly has a zipper located around the center line to allow full opening of the cover for installation or removal of the water bladder. In addition, the single bladder can be removed and replaced with foam to convert the mattress to an entirely foam construction, half foam and half water construction, or two separate water bladders to further lessen water motion. The top of the cover has a layer of quilted material covered by layers of foam sewn into the cover to provide insulation to render the bed warm and comfortable without the use of any water bed heater. A sheet of non-stretchable fabric covers the foam between the bladder and the quilted top and is sewn to the cover to retain the foam when opening and closing the cover.

The essence of the invention is the provision of a water bed mattress construction having a self-supporting foam frame assembly comprised of three layers of foam encased in a rectangular box of non-stretchable fabric. The top layer of foam is a foam having a high recovery factor surrounding the perimeter of the cavity to prevent the foam from taking a compression set over a long period of use.

It is one object of the present invention to provide an improved water bed mattress construction.

Another object of the present invention is to provide a water bed mattress construction having a self-supporting foam frame assembly.

It is another object of the present invention to provide a water bed mattress construction which eliminates the need for heating of the water.

Still another object of the present invention is to provide a water bed mattress construction which has the appearance of a conventional mattress.

Still another object of the present invention is to provide a water bed mattress construction which retains its shape over the long periods of use.

Yet another object of the present invention is to provide a foam frame construction having an interior surface with an angular wall, to reduce excessive water movement that will disturb the user's sleep.

Another object of the present invention is to provide a water bed mattress construction which can be readily converted to a 50% conventional foam construction plus 50% water bed, or be converted to utilize two single-size bladders, or be converted to a 100% conventional foam construction.

Other objects, advantages and novel features of the invention will become apparent from the following detailed description of the invention when considered in conjunction with the accompanying drawings wherein like numbers identify like parts throughout.

DETAILED DESCRIPTION OF THE PREFERRED EMBODIMENT

Until now, water beds generally have had the image of big, bulky, rustic, rough, heavy devices and a solid or rigid wood frame only desirable for use under certain circumstances. Flotation sleeping presents some distinct advantages and it would be preferable if mattresses could be constructed which provide such advantages, while still having the appearance and ease of use of a conventional mattress.

Figure 1:
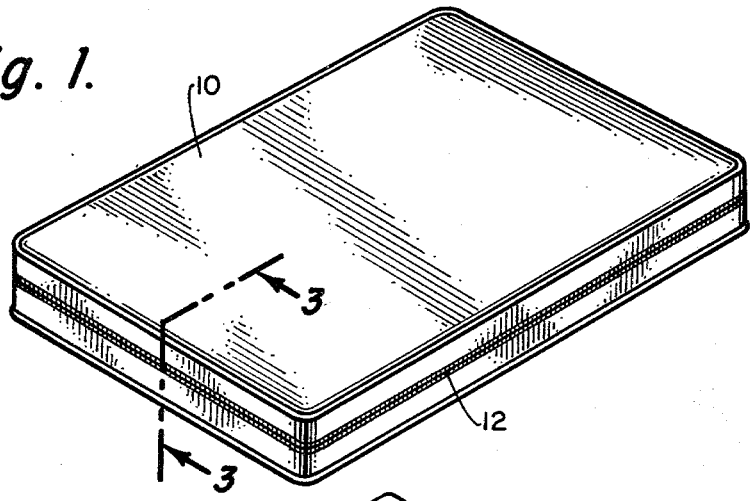
FIG. 1 is a perspective view of the water bed mattress of the invention.

Referring now to FIG. 1, there is shown a water bed mattress 10 of the present invention having the appearance of a conventional mattress. The mattress 10 is designed with a zipper 12 located at the center line which is full length and begins and ends around the top end of the mattress to allow for full opening of the cover (FIG. 3) for installation or removal and reinstallation of a water bladder which will be described more fully hereinafter.

Figure 2:
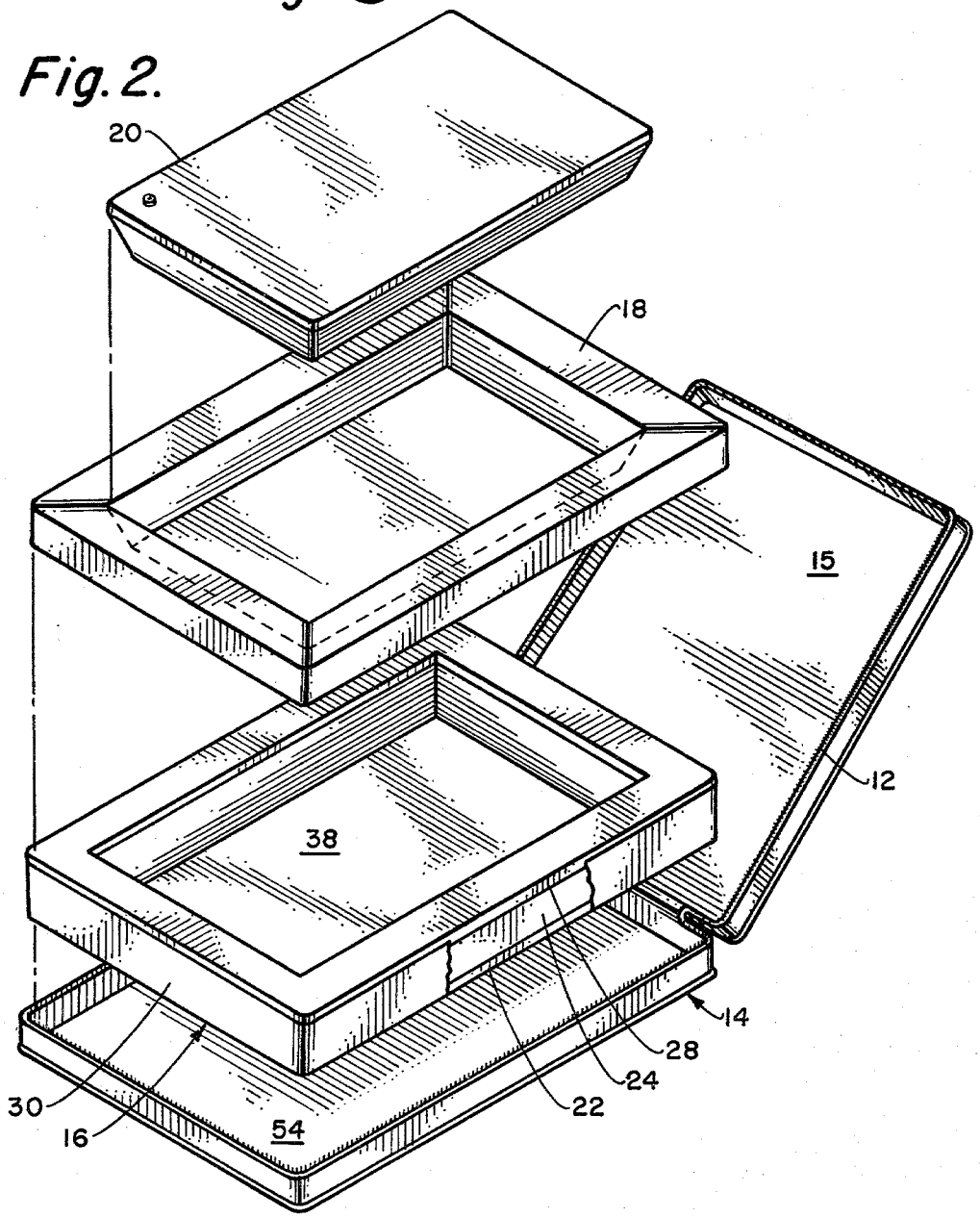
FIG. 2 is an exploded view of the water bed mattress of the invention showing the various components.

The mattress construction has a number of separate and distinct components illustrated in FIG. 2. In this figure there is shown a cover 14 which encloses a foam frame assembly 16 having a cavity 38 over which is fitted a contoured vinyl liner 18, prior to the installation of a water bladder 20. The interior of the mattress 10 is easily accessible by opening the zipper 12 around the center line of the cover 14. The important features of the invention are the manner in which the foam frame assembly 16 is constructed to be self supporting, and the inclusion of insulation 15 in the cover 14 permitting the mattress to be used in a water bed without any need for a heater.

Figure 3:
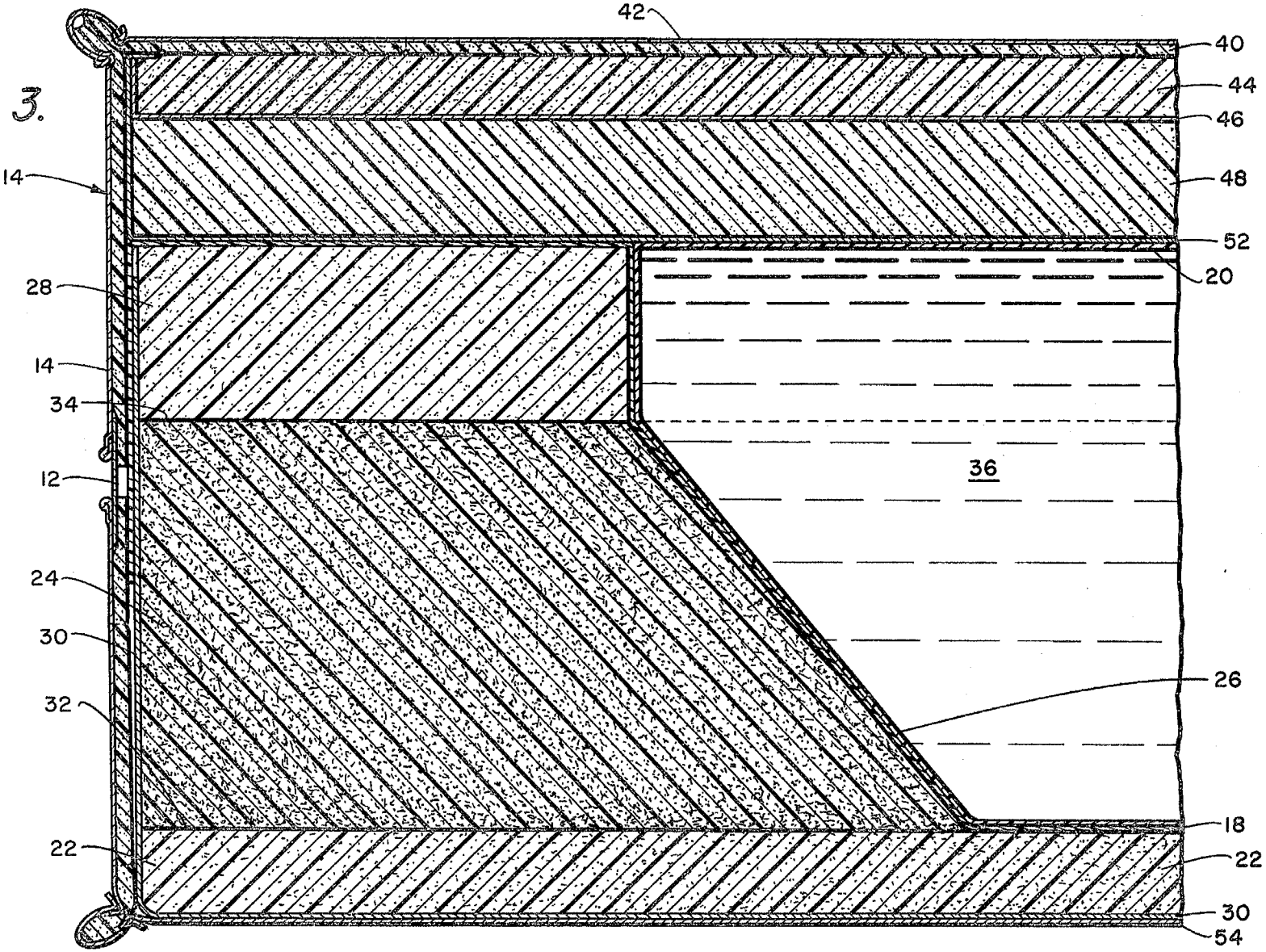
FIG. 3 is a sectional view of the water bed mattress construction of FIG. 1 taken at 2—2.

The particular construction of the mattress is illustrated more clearly in FIG. 3. The self-supporting foam frame assembly 16 is constructed without any solid or rigid members such as wood in the sides or bottom. Thus, the foam frame is designed as entirely self supporting. This foam frame is constructed of three layers of foam each having a different density. The bottom layer 22 is a soft, compressible, elastomeric foam in a rectangular shape covering the entire bottom of the mattress and providing a bonding surface for the olefin frame binder 30 that holds the entire frame together. The center layer 24 is constructed of a medium density, firm but compressible angular elastomeric foam, acting as a supporting member. The central portion of the medium density foam is a foam having a high hysteresis effect and is cut in the form of a modified trapezoid having sides 26 at angles of approximately 50° to the horizontal. Each angular cut side is in the form of an isosceles trapezoid, thus forming an inverted, truncated pyramid-shaped cavity 38 for holding the bladder 20.

The top layer of foam 28 is of great importance as it not only must be strong enough to resist wear, but also it also must be soft to the touch and have a high recovery factor. That is, this layer of foam around the perimeter of cavity 38 on top of the center layer 24 is of low density elastomeric foam and has a low percentage hysteresis loss factor. Preferably the foam 28 will have a greater than a 95% recovery factor preventing the occurrence of any compression set or sag around the edges of the mattress over long periods of use. The bottom layer 22 will typically have a density of approximately less than 1.3, while the center layer 24 will typically have a density in the range of 3 to 5 pounds per cubic foot.

In order to maintain the shape of the foam frame assembly the entire foam frame assembly is wrapped in high-strength, non-stretchable, non-water-absorbent material that supports the entire foam frame assembly. The foam frame assembly enclosure 30 is comprised of a non-woven polypropylene fabric formed (sewn) into a rectangular box-like shape and fitted over the foam frame assembly. In order to prevent shifting of the foam frame in the non-stretchable fabric wrapping, the enclosure is securely bonded to the foam with an adhesive. Likewise, the mating surfaces 32 and 34 of respective foam layers are also bonded securely with a suitable adhesive. The entire foam frame assembly 16 described provides a self-supporting frame for the bladder 20 when filled with water 36 in the usual manner.

To cover the entire foam frame assembly 16 and protect it from any damage from leakage or spilling of water, a contoured form-fitting vinyl liner or slipcover 18 is provided which fits snugly over the sides and top of the foam frame assembly 16 and fits the contour of the coffer or cavity 38 formed in the frame 16. This can be seen more clearly by referring to the FIG. 2. The cover 14 is constructed from a highly decorative material having quilting 40 in the usual fashion and including layers of foam providing substantial insulation so that no heater is needed for use with the mattress. As illustrated in FIG. 2, the top 42 of the cover 14 includes a first layer 44 of low-density foam, similar in density to that of layer 22 covered by a filler clotch 46 and a second layer of foam 48 of the same density and more than double the thickness of the first layer. Then, an additional sheet of non-stretchable fabric 52 is sewn into the cover 14 retaining this entire top coverlet insulation in place.

The bottom of the cover 14 is also structured of a sheet of this non-stretchable fabric 54 sewn to the sides of the quilted cover. In order to retain the cover 14 on the foam frame 16, it is preferable that the mating surface of the non-stretchable fabric 54 and the non-stretchable wrapping or binding 30 around the frame assembly 16 be bonded with a suitable adhesive. This prevents any shifting of the cover 14, further assisting in retention and appearance of the mattress.

As was discussed previously, the foam frame assembly construction 16 provides a cavity 38 which is a modified trapezoid or inverted truncated pyramid shape for specific reasons. The purpose for this frame design and its 50° angle to the horizontal is to alter the hydrodynamics when a user is lying on the water bed. The effect of this shape is a dampening which changes the direction of water flow in a manner that will create a mild roll as opposed to an ocean-like wave effect in the conventional water bed. The water displacement is projected sideways and upwards simultaneously with a comfortable back flow. The redirection of water flow decreases the roll effect while eliminating a feeling of bottoming out.

As was discussed previously, the cover or ticking 14 is constructed of a highly decorative durable material or damask covering 42, incorporating quilted padding 40 into which the layers 44 and 48 of foam insulation are sewn. In use the zipper 12 is opened allowing the coverlet or top 15 (FIG. 2) to be opened, exposing the interior for removal, replacement or filling of the bladder 20. The bladder is designed specifically to fit the cavity 38 and is made of a high-strength durable vinyl to ensure against leaks or punctures. In any event, a contoured, form-fitting vinyl liner 18 is provided as additional protection for the foam frame.

The novel construction disclosed provides all the comforts and advantages of flotation or water bed sleeping without the disadvantages. That is, the bladder provides approximately one-third less weight and requires no heating because of the construction disclosed. In addition, there is no bulging, bending or distortion of the foam frame after long periods of use. Also, the mattress, while providing all these advantages, has the same size and height as padded foam or innerspring mattresses.

Another advantage of this invention is that the bladder 20 can be readily removed and a foam insert formed to fit the cavity 38 inserted in the event the user or purchaser desires to convert the mattress to a conventional foam construction. Additionally, a full-size mattress can be provided with a dual construction by making the bladder 20 half the width of the cavity 38 and filling the remaining half with a foam, or it can be fitted with two individual bladders that will further restrict water movement and insure the user's sleeping comfort. Because of the low weight of this device, it can be used much as a conventional mattress when mounted on a heavy-duty frame. The heart of the novel mattress construction is the foam frame assembly and the non-stretchable fabric encasing the entire assembly so that it will retain substantially its original shape over long periods of use without bending, warping, bulging, or otherwise losing its shape. In addition, the top layer of foam incorporated into the foam frame assembly also prevents any compression set from long periods of use. Thus, the mattress construction is designed not only for sleeping comfort, but also for rising without the discomfort indigenous to hard-framed water beds.

Obviously many modifications and variations of the present invention are possible in light of the above teachings. It is therefore to be understood that the full scope of the invention is not limited to the details disclosed herein and may be practiced otherwise than as specifically described.

What is claimed is:

1. A fluid cell mattress construction comprising:
- a rectangular layer of low-density elastomeric foam;
- an intermediate rectangular layer of medium-density elastomeric foam on top of said low-density foam forming a cavity;
- a rectangular layer of low-density elastomeric foam around the perimeter of said cavity on top of said medium-density foam;
- a rectangular cover of substantially non-stretchable fabric covering the bottom and sides formed by the three layers of foam, thereby forming the foam layers into a self-supporting frame;
- a fluid bladder formed to fit into said cavity;
- a second layer of low-density foam covering the top of said layers of foam and said bladder; and
- a cover of ticking enclosing the assembly of layers of foam and said bladder.

2. The mattress construction according to claim 1 wherein said non-stretchable fabric is bonded to the layers of foam forming the sides and bottom of said mattress construction.

3. The mattress construction according to claim 1 wherein said cavity formed by said medium-density foam is an inverted truncated pyramid.

4. The mattress construction according to claim 3 wherein the sides of said truncated pyramid angle outwardly at approximately 50° to the horizontal.

5. The mattress construction according to claim 1 wherein said second layer of foam is covered with non-stretchable fabric and sewn to the ticking.

6. The mattress construction according to claim 1 wherein the bottom of said mattress construction is covered with non-stretchable fabric sewn to the ticking covering the sides.

7. The mattress construction according to claim 6 wherein the bottom cover of non-stretchable fabric is bonded to the non-stretchable fabric box-like structure covering the foam.

8. The mattress construction according to claim 1 including:
- a water-impervious liner covering the top, sides and cavity formed by the three layers of foam beneath said fluid bladder.

9. The mattress construction according to claim 1 wherein said bladder has a length equal to the cavity and a width equal to one-half the cavity whereby the other half of the cavity may be filled with a foam insert thereby forming a half-fluid and half-foam mattress.

10. The mattress construction according to claim 1 wherein said non-stretchable fabric is a polypropylene non-woven fabric.

11. A water mattress construction comprising:
- a rectangular frame of medium-density elastomeric foam bonded on top of the low-density foam forming a cavity having sides in the form of isosceles trapezoids;
- a rectangular frame of medium density bonded to the top of the high density foam;
- a substantially non-stretchable fabric binder formed into a substantially rectangular box covering the bottom and sides of said layers of foam;
- adhesive means bonding said non-stretchable fabric to said foam layers;
- a vinyl liner covering the interior of said cavity;
- a bladder filled with water filling said cavity;
- a second rectangular layer of low-density foam covering said bladder and said frame of medium-density foam;
- a cover of ticking enclosing the top, bottom and sides of said layers of foam and non-stretchable fabric.

12. The water mattress construction according to claim 11 wherein said non-stretchable fabric is comprised of a non-woven polypropylene fabric binder.

13. The water mattress construction according to claim 11 wherein said cover includes a rectangular sheet of non-stretchable fabric on the bottom of said mattress construction.

14. The water mattress construction according to claim 13 including an adhesive bonding the rectangular sheet of non-stretchable fabric to the rectangular box of non-stretchable fabric.

15. A method of constructing a fluid cell mattress comprising:
- forming a rectangular layer of low-density foam;
- forming a cavity having sides in the shape of isosceles trapezoids and rectangular top and bottom in a medium-density foam;
- bonding the medium-density foam onto the layer of low-density foam;
- bonding the layer of low-density foam on top of the medium-density foam around the perimeter of said cavity;
- forming a substantially non-stretchable fabric into a substantially rectangular box;
- covering the bottom and sides formed by the layers of low-density and medium-density foam with the rectangular box of non-stretchable fabric;
- bonding the non-stretchable fabric to the foam;
- installing a bladder fitted to said cavity;
- covering the bladder and top layer of medium-density foam with a rectangular layer of foam;
- enclosing the sides and top of the foam layer assembly in a cover of ticking.

16. The method according to claim 15 including:

securing a sheet of non-stretchable fabric to said ticking to cover the bottom of said foam layer assembly.

17. The method according to claim 16 including:

bonding said sheet of non-stretchable fabric to the non-stretchable fabric formed into a rectangular box.

18. A water mattress construction comprising:

a foam frame assembly having a cavity;

a substantially non-stretchable fabric enclosing the sides and bottom of said foam frame assembly, thereby forming the foam frame assembly into a self-supporting frame;

a fluid bladder in said cavity; and enclosing cover means enclosing said frame assembly and said bladder.

19. The mattress construction according to claim 18 wherein said foam assembly comprises:

top and bottom rectangular layers of foam having a predetermined density; and a center layer of foam framing said cavity having a density greater than said top and bottom layers.

20. The mattress construction according to claim 18 wherein said non-stretchable fabric is bonded to the foam assembly.

21. The mattress construction according to claim 19 wherein said foam assembly includes a layer of foam on the central layer around the perimeter of said cavity having a predetermined maximum recovery factor.

22. The mattress construction according to claim 18 wherein said enclosing cover includes a sheet of non-stretchable fabric on the bottom of said mattress.

23. The mattress construction according to claim 22 wherein said sheet of non-stretchable fabric is bonded to the non-stretchable fabric covering said foam assembly.

24. The mattress construction according to claim 18 wherein said non-stretchable fabric is non-woven polypropylene fabric.

25. The mattress construction according to claim 18 wherein said cavity is a substantially inverted truncated pyramid having sides approximately 50° to the horizontal.

26. The mattress according to claim 18 including a contoured vinyl liner covering said foam frame assembly and said cavity.

* * * * *